US005952167A

United States Patent [19]

Okada et al.

[11] Patent Number: 5,952,167

[45] **Date of Patent: *Sep. 14, 1999**

[54] PHOTOTHERMOGRAPHIC MATERIALS

[75] Inventors: Hisashi Okada; Naoki Asanuma; Ichizo Toya, all of Minami Ashigara, Japan

[73] Assignee: Fuji Photo Film Co., Ltd., Kanagawa, Japan

[ * ] Notice: This patent is subject to a terminal disclaimer.

[21] Appl. No.: 08/812,132

[22] Filed: Mar. 5, 1997

[30] Foreign Application Priority Data

Jun. 5, 1996 [JP] Japan ..... 8-047204

[51] Int. Cl.[6] ..... G03C 1/498; G03C 1/34

[52] U.S. Cl. ..... 430/619; 430/600; 430/607; 430/613; 430/614; 430/617

[58] Field of Search ..... 430/617, 619, 430/613, 614, 607, 600

[56] References Cited

U.S. PATENT DOCUMENTS

| | | | |
|---|---|---|---|
| 3,874,946 | 4/1975 | Costa et al. . | |
| 3,874,949 | 4/1975 | Kaneda et al. . | |
| 4,756,999 | 7/1988 | Swain et al. . | |
| 5,340,712 | 8/1994 | Dunn et al. . | |
| 5,374,514 | 12/1994 | Kirk et al. | 430/619 |
| 5,656,419 | 8/1997 | Toya et al. | 430/619 |

FOREIGN PATENT DOCUMENTS

| | | |
|---|---|---|
| 0 605 981 A1 | 7/1994 | European Pat. Off. . |
| 0 631 176 A1 | 12/1994 | European Pat. Off. . |
| 50-89020 | 7/1975 | Japan . |
| 50-120328 | 9/1975 | Japan . |
| 50-137126 | 10/1975 | Japan . |
| 54-165 | 1/1979 | Japan . |
| 7-2781 | 1/1995 | Japan . |

*Primary Examiner*—Thorl Chea

*Attorney, Agent, or Firm*—Birch, Stewart, Kolasch & Birch, LLP

[57] ABSTRACT

A photothermographic material comprising (a) a reducible silver source, (b) a photocatalyst, (c) a reducing agent, (d) a binder, and (e) a compound represented by the following formula (I):

(I)

wherein Q represents an atomic group necessary to form a six-membered heterocycle containing two to four nitrogen atoms; Y represents —CO—, —SO—, or —$SO_2$—; $X_1$ and $X_2$ each represent a halogen atom; and A represents a hydrogen atom or an electron withdrawing group, the photothermographic material exhibiting low fogging without deterioration in image tone and sensitivity decrease.

18 Claims, No Drawings

PHOTOTHERMOGRAPHIC MATERIALS

FIELD OF THE INVENTION

The present invention relates to a photothermographic material, and particularly, to techniques for promoting fog decrease and improving storage characteristics of the photographic material and image without sensitivity decrease and deterioration in image tone.

BACKGROUND OF THE INVENTION

Photothermographic materials which form photographic images by a heat development method are disclosed, for example, by U.S. Pat. Nos. 3,152,904 and 3,457,075, and D. Morgan and B. Shely, *Thermally Processed Silver Systems; Imaging Processes and Materials*, Neblette, the 8th edition, Sturge, edited by V. Walworth, and A. Shepp, page 2 (1966).

These photothermographic materials comprise a reducible silver source (for example, organic silver salts), a catalytic amount of a photocatalyst (for example, silver halides), and a reducing agent, these components being customarily in a state dispersed into a matrix of an (organic) binder. Although the photothermographic materials are stable at ordinary temperature, silver is formed, after exposure, through an oxidation-reduction reaction between the reducible silver source (acting as an oxidating agent) and the reducing agent with the aid of heat (for example, 80° C. or higher). This oxidation-reduction reaction is promoted by the catalysis of latent images produced by exposure. The silver formed by the reaction of the organic silver salts in exposed areas provides black images to attain image formation in contrast with unexposed areas. Toning agents are used as needed for the photosensitive materials in order to control the image tone of the silver images.

A method so far used most effectively as a conventional technique for antifogging has been to use mercury compounds as antifoggants. Such use of the mercury compounds for the photographic materials is disclosed, for example, by U.S. Pat. No. 3,589,903. However, the mercury compounds encounter an environmental problem, and non-mercury antifoggants have been expected to be exploited. So far, various types of polyhalogen compounds have been disclosed for the non-mercury antifoggants, for example, by U.S. Pat. Nos. 3,874,946, 4,756,999 and 5,340,712, European Patents 605,981A1, 622,666A1 and 631,176A1, JP-B-54-165 (The term "JP-B" as used herein means an "examined Japanese patent publication"), and JP-A-7-2781 (The term "JP-A" as used herein means an "unexamined published Japanese patent application"). However, these compounds described therein have the disadvantages of having only a small effect on the antifogging and deteriorating the image tone of the silver, and further, there also are some compounds which bring about a great effect on the antifogging but cause sensitivity decrease. Thus, improvements in antifogging have been required in this field. Furthermore, when a pile of these photographic materials undergoes aging under forced conditions of high temperatures and high humidities, the photographic materials suffer fog increase in unexposed areas after exposure and development. Thus, antifoggants producing no such troubles have been expected to be exploited

SUMMARY OF THE INVENTION

An object of the present invention is to provide a photothermographic material which generates no deterioration in image tone, no sensitivity decrease, and little fog.

This object of the present invention is achieved by the following means:

(1) A photothermographic material comprising (a) a reducible silver source, (b) a photocatalyst, (c) a reducing agent, (d) a binder, and (e) a compound represented by formula (I) given below.

(2) A photothermographic material comprising (a) an organic silver salt, (b) a reducing agent, (c) a photosensitive silver halide and/or photosensitive silver halide-formable component, (d) a binder, and (e) a compound represented by the following formula (I):

(I)

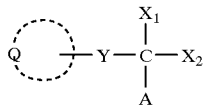

wherein Q represents an atomic group necessary to form a six-membered unsaturated heterocycle containing two to four nitrogen atoms; Y represents —CO—, —SO—; or —$SO_2$—; $X_1$ and $X_2$ each represents a halogen atom, and A represents a hydrogen atom or an electron withdrawing group.

(3) A photothermographic material described in (1) or (2), which is sensitized in the infrared region for exposure to infrared laser rays.

DETAILED DESCRIPTION OF THE INVENTION

The compounds represented by formula (I) are described in detail herein below.

The six-membered unsaturated heterocycles containing two to four nitrogen atoms, which is represented by Q, may be either monocyclic compounds or rings fused together with other rings.

Examples of such six-membered unsaturated heterocycles represented by Q include pyrazine, pyrimidine, pyridazine, triazine, tetrazine, purine, pyrazolopyradine, triazolopyridazine, triazolopyrazine, phthalazine, benzotriazine, quinoxaline, quinazoline, cinnoline, pteridine, perimidine, tetrazaindene and pyridopyridazine. Of these heterocycles, preferred ones are pyrazine, pyrimidine, pyridazine, triazine, phthalazine, quinoxaline, quinazoline, cinnoline and pteridine; more preferred ones are pyrazine, pyrimidine, pyridazine, phthalazine, quinoxaline and quinazoline; and most preferred ones are pyrazine, pyrimidine and pyridazine.

These six-membered unsaturated heterocycles represented by Q link to Y via the carbon atom or the nitrogen atom, and preferably via the carbon atom in the heterocycles.

Said six-membered unsaturated heterocycles represented by Q may contain substituent groups. Examples of the substituent groups include alkyl groups preferably having one to 20, more preferably one to 12, and most preferably one to eight carbon atoms (for example, methyl, ethyl, isopropyl, tert-butyl, n-octyl, n-decyl, n-hexadecyl, cyclopropyl, cyclopentyl and cyclohexyl); alkenyl groups preferably having two to 20, more preferably two to 12 and, most preferably two to eight carbon atoms (for example, vinyl, allyl, 2-butenyl and 3-pentenyl), alkynyl groups preferably having two to 20, more preferably two to 12 and, most preferably two to eight carbon atoms (for example, propargyl and 3-pentynyl), aryl groups preferably having six to 30, more preferably six to 20 and, most preferably six to 12 carbon atoms (for example, phenyl, p-methylphenyl and naphthyl), amino groups preferably having zero to 20, more preferably zero to 10, and most preferably zero to six carbon atoms (for example, amino, methylamino, dimethylamino, diethylamino, and dibenzylamino); alkoxy groups preferably having one to 20, more preferably one to 12, and most preferably one to eight carbon atoms (for example, methoxy, ethoxy and butoxy); aryloxy groups preferably six to 20, more preferably six to 16, and most preferably six to 12 carbon atoms (for example, phenyloxy and 2-naphthyloxy); acyl groups preferably having one to 20, more preferably one to 16, and most preferably one to 12 carbon atoms (for example, acetyl, benzoyl, formyl and pivaloyl); alkoxycarbonyl groups preferably having two to 20, more preferably two to 16, and most preferably two to 12 carbon atoms (for example, methoxycarbonyl and ethoxycarbonyl); aryloxycarbonyl groups preferably having seven to 20, more preferably seven to 16, and most preferably seven to ten carbon atoms (for example, phenyloxycarbonyl); acyloxy groups preferably having two to 20, more preferably two to 16, and most preferably two to ten carbon atoms (for example, acetoxy and benzoyloxy); acylamino groups preferably having two to 20, more preferably two to 16, and most preferably two to ten carbon atoms (for example, acetylamino and benzoylamino); alkoxycarbonylamino groups preferably having two to 20, more preferably two to 16, and most preferably two to 12 carbon atoms (for example, methoxycarbonylamino); aryloxycarbonylamino groups preferably having seven to 20, more preferably seven to 16, and most preferably seven to 12 (for example, phenyloxycarbonylamino); sulfonylamino groups preferably having one to 20, more preferably one to 16, and most preferably one to 12 carbon atoms (for example, methanesulfonylamino and benzenesulfonylamino); sulfamoyl groups preferably having zero to 20, more preferably zero to 16, most preferably zero to 12 carbon atoms (for example, sulfamoyl, methylsulfamoyl, dimethylsulfamoyl and phenylsulfamoyl); carbamoyl groups preferably having one to 20, more preferably one to 16, and most preferably one to 12 carbon atoms (for example, carbamoyl, methylcarbamoyl, diethylcarbamoyl and phenylcarbamoyl); alkylthio groups preferably having one to 20, more preferably one to 16, and most preferably one to 12 carbon atoms (for example, methylthio and ethylthio); arylthio groups preferably having six to 20, more preferably six to 16, and most preferably six to 12 carbon atoms (for example, phenylthio); sulfonyl groups preferably having one to 20, more preferably one to 16, and most preferably one to 12 carbon atoms (for example, mesyl and tosyl); sulfinyl groups preferably having one to 20, more preferably one to 16, and most preferably one to 12 carbon atoms (for example, methanesulfinyl and benzenesulfinyl); ureido groups preferably having one to 20, more preferably one to 16, and most preferably one to 12 carbon atoms (for example, ureido, methylureido and phenylureido); phosphoric acid amide groups preferably having one to 20, more preferably one to 16, and more preferably one to 12 carbon atoms (for example, diethylphosphoric acid amide and phenylphosphoric acid amide); a hydroxy group; a mercapto group; halogen atoms (for example, fluorine, chlorine, bromine, and iodine); a cyano group; a sulfo group; a carboxyl group; a nitro group; hydroxamic acid groups; sulfino groups; hydrazino groups; and heterocyclic groups (for example, imidazolyl, pyridyl, furyl, piperidyl, and morpholino). These substituent groups may contain additional substituent groups. Further, when two or more substituent groups exist in a heterocycle, they may be the same with or different from one another.

Preferred examples of the additional substituent groups include alkyl groups, aryl groups, alkoxy groups, aryloxy groups, acyl groups, alkoxycarbonyl groups, aryloxycarbonyl groups, acyloxy groups, acylamino groups, alkoxycarbonylamino groups, aryloxycarbonylamino groups, sulfonylamino groups, sulfamoyl groups, carbamoyl groups, ureido groups, phosphoric acid amide groups, a hydroxy group, halogen atoms, a cyano group, a sulfo group, a carboxyl group, a nitro group, hydroxamic acid groups, sulfino groups, hydrazino groups, and hetero-cyclic groups. Of these substituent groups, more preferred examples thereof are alkyl groups, aryl groups, alkoxy groups, aryloxy groups, acyl groups, alkoxycarbonyl groups, aryloxycarbonyl groups, acyloxy groups, a hydroxy group, halogen atoms, a cyano group, and heterocyclic groups; most preferred examples thereof are alkyl groups, aryl groups, alkoxy groups, aryloxy groups, acyl groups, halogen atoms, a cyano group, and heterocyclic groups; and particularly preferred examples alkyl groups, aryl groups, and heterocyclic groups.

Y represents —CO—, —SO—, or —$SO_2$—, preferably —CO— or —$SO_2$—, and more preferably —$SO_2$—.

The halogen atoms represented by $X_1$ and $X_2$, which may be the same with or different from one another, each are a fluorine atom, a chlorine atom, a bromine atom, or an iodine atom, more preferably a chlorine atom or a bromine atom, and most preferably a bromine atom.

The electron withdrawing groups represented by A are groups preferably having Hammett's substituent constants $\sigma_p$'s of 0.01 or more, and more preferably of 0.1 or more. For Hammett's substituent constants, reference can be made to *Journal of Medicinal Chemistry*, Vol. 16, No. 11, pp. 1207–1216 (1973) and so forth. Examples of such electron withdrawing groups include halogen atoms such as a fluorine atom ($\sigma_p$ value: 0.06), a chlorine atom ($\sigma_p$ value: 0.23), a bromine atom ($\sigma_p$: 0.23), and an iodine atom ($\sigma_p$: 0.18); trihalomethyl groups such as a tribromomethyl group ($\sigma_p$: 0.29), a trichloromethyl group ($\sigma_p$: 0.33), and a trifluoromethyl group ($\sigma_p$: 0.54); a cyano group ($\sigma_p$: 0.66); a nitro group ($\sigma_p$: 0.78); aliphatic, aromatic (e.g., aryl) and heterocyclic sulfonyl groups such as a methanesulfonyl group ($\sigma_p$: 0.72); aliphatic, aromatic (e.g., aryl) and heterocyclic acyl groups such as an acetyl group ($\sigma_p$: 0.50), a benzoyl group ($\sigma_p$: 0.43); alkynyl groups such as $C_3H_3$ ($\sigma_p$: 0.09); aliphatic, aromatic (e.g., aryl) and heterocyclic oxycarbonyl groups such as a methoxycarbonyl group ($\sigma_p$: 0.45) and a phenoxycarbonyl group ($\sigma_p$: 0.45); a carbamoyl group ($\sigma_p$: 0.36); and a sulfamoyl group ($\sigma_p$: 0.57).

Of these electron withdrawing groups represented by A, preferred groups are halogen atoms; aliphatic, aromatic (e.g., aryl) and heterocyclic sulfonyl groups; aliphatic, aromatic (e.g., aryl) and heterocyclic acyl groups; and aliphatic, aromatic (e.g., aryl) and heterocyclic oxycarbonyl groups; and particularly preferred groups are halogen atoms. Of the halogen atoms, a chlorine atom, a bromine atom, and an iodine atom are preferred, a chlorine atom and a bromine atom are more preferred, and a bromine atom is particularly preferred.

Of the compounds represented by formula (I), preferred compounds are those represented by formula (I-a):

(I-a)

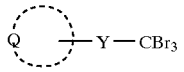

wherein Q and Y have the same meanings and the same preferred ranges as those in formula (I), respectively.

Of the compounds represented by formula (I), more preferred compounds are those represented by formula (I-b):

(I-b)

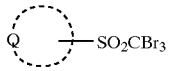

wherein Q' represents an atomic group necessary to form a pyrazine ring, a pyrimidine ring or a pyridazine ring.

Of the compounds represented by formula (I), most preferred compounds are those represented by formula (I-c):

(I-c)

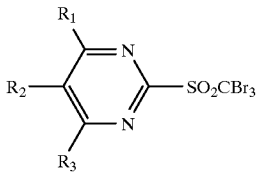

wherein $R_1$, $R_2$ and $R_3$ each represent an hydrogen atom or a substituent group. The substituent groups represented by $R_1$, $R_2$ and $R_3$ include those which are enumerated for the heterocyclic rings represented by Q in formula (I). $R_1$ and $R_3$ are each preferably a hydrogen atom, an alkyl group, an aryl group, and a heterocyclic group, and more preferably a hydrogen atom and an alkyl group. $R_2$ is preferably a hydrogen atom, an alkyl group, an aryl group, and a heterocyclic group, and more preferably a hydrogen atom. It is particularly preferred that $R_2$ is a hydrogen atom, and simultaneously, $R_1$ and $R_3$ are each a hydrogen atom or an alkyl group.

Examples of the compounds represented by formula (I) are shown below, and however, the present invention is not limited by these examples.

1.

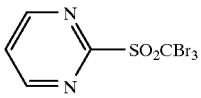

2.

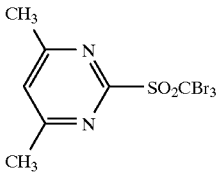

3.

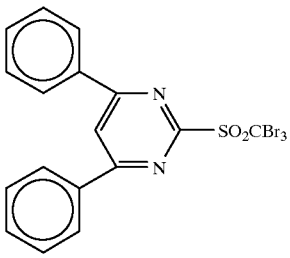

-continued

4.

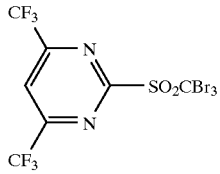

5.

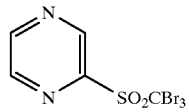

6.

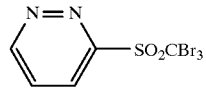

7.

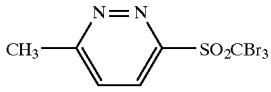

8.

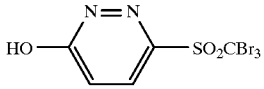

9.

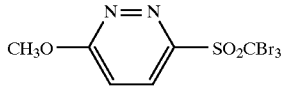

10.

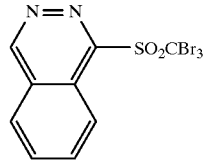

11.

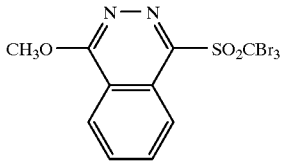

12.

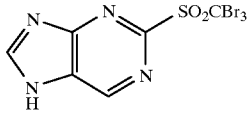

-continued
13.
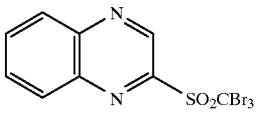
14.
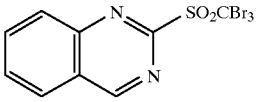
15.
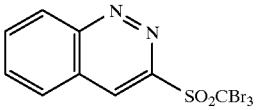
16.
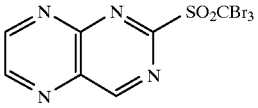
17.
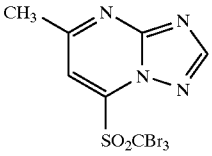
18.
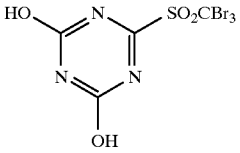
19.
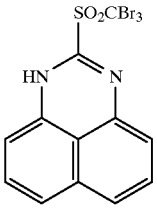
20.
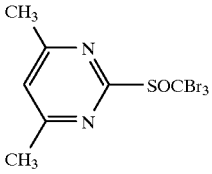
-continued
21.
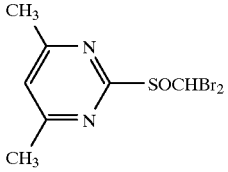
22.
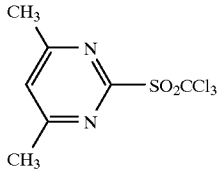
23.
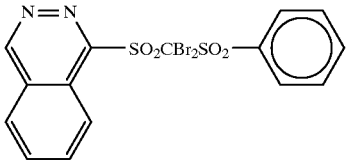
24.
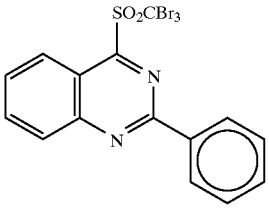
25.
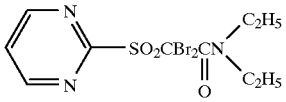
26.
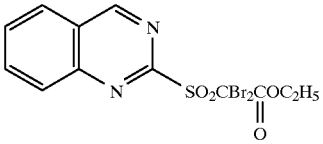
27.
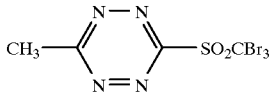

-continued

28.

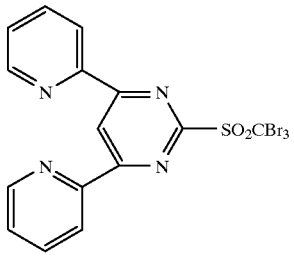

29.

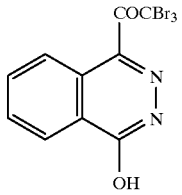

30.

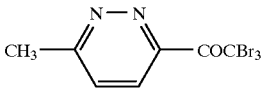

31.

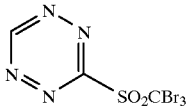

32.

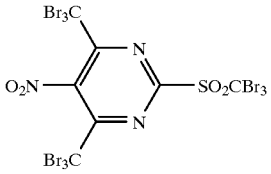

33.

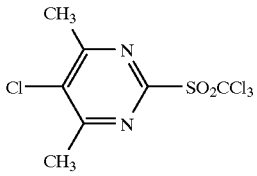

34.

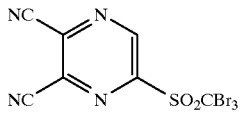

-continued

35.

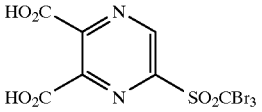

The compounds represented by formula (I) of the present invention can be prepared according to procedures described, for example, in JP-A-54-165, JP-A-6-340611, JP-A-7-2781, JP-A-7-5621, JP-B-7-119953, U.S. Pat. Nos. 5,369,000, 5,374,514, 5,460,938 and 5,464,737, and European Patents 605,981 and 631,176.

A procedure for preparing a compound represented by formula (I) is described below.

SYNTHESIS EXAMPLE 1

Synthesis of Compound 2

Synthesis of 4,6-Dimethyl-2-carboxymethylthiopyrimidine:

A mixture of 28.0 g (0.20 mol) of 4,6-dimethyl-2-mercaptopyrimidine, 27.0 g (0.22 mol) of chloroacetic acid, and 300 ml of ethanol were stirred at room temperature, and a solution of 8.8 g (0.22 mol) of sodium hydroxide in 15 ml of water was slowly added dropwise to the mixture. After stirring for 20 minutes, the resulting mixture was heated to 50° C., a solution of 8.8 g (0.22 mol) of sodium oxide in 15 ml of water was slowly added thereto, and stirring was further continued at 50° C. for 3 hours. Thereafter, the reaction mixture was cooled to room temperature, water was added thereto until the mixture formed a homogeneous solution, and hydrochloric acid was further added to neutralize the solution. Crystals thus obtained were collected, and recrystallized from methanol to obtain 28.3 g (0.14.3 mol) of 4,6-dimethyl-2-carboxymethylthiopyrimidine. Yield: 72%.

Synthesis of 4,6-Dimethyl-2-tribromomethylsulfonylpyrimidine:

31.1 ml of bromine was slowly added dropwise with stirring at 0 to 5° C. to a solution of 49.1 g (1.23 mol) of sodium hydroxide in 1 liter of water, and further, an aqueous solution of 14.0 g (0.0706 mol) of 4,6-dimethyl-2-mercaptopyrimidine obtained above, 7.2 g (0.0857 mol) of sodium hydrogencarbonate and 150 ml of water was slowly added dropwise thereto while maintaining the reaction mixture at temperatures not exceeding 10° C. After completing the addition of the aqueous solution, the temperature of the resulting reaction mixture was raised to room temperature, and the reaction mixture was allowed to stand overnight. Crystals thus obtained were collected, washed with water, and recrystallized from ethanol to obtain 14.3 g (0.0339 mol) of compound 2 as a white solid. Melting points 184–186° C.; Yield: 48%.

In the present invention, the compounds represented by formula (I) can be incorporated into a photosensitive layer or a light-insensitive layer, and preferably into the photosensitive layer. The contents of the compounds represented by formula (I) are from $10^{-4}$ to 1 mol per mol of silver, and preferably from $10^{-3}$ to 0.3 mol per mol of silver, although they can vary as needed. The compounds represented by formula (I) are favorably dissolved in an organic solvent prior to the use thereof.

In view of environmental protection, it is preferred that the photothermographic material of the present invention is a monosheet type photothermographic material (a type in which all materials provided for forming images are incorporated in the image sheet to be viewed).

Further, it is preferred that the photothermographic material of the present invention is for exposure to an infrared laser ray. The wavelengths of the infrared laser ray are preferably 750 nm or more, and more preferably 800 nm or more. Corresponding to the laser ray having such a wavelength region, the photothermographic material should be subjected to spectral sensitization so as to have sensitivity in these wavelength region, that is, in the infrared region. Known infrared sensitizing dyes can be used for this purpose.

In the photothermographic material of the present invention, photographic images are formed through heat development processing. As described previously, such photothermographic materials are disclosed, for example, by U.S. Pat. Nos. 3,152,904 and 3,457,075, and D. Morgan and B. Shely, *Thermally Processed Silver Systems; Imaging Processes and Materials*, Neblette, the 8th edition, Sturge, Edited by V. Walworth, and A. Shepp, page 2 (1969).

The photothermographic material of the present invention is at least that which forms photographic images through the heat development processing. It is preferred, however, that the photothermographic materials may contain a reducible silver source (for example, organic silver salts), a catalytic amount of a photocatalyst (for example, photosensitive silver halides and/or photosensitive silver halide-formable components), and a reducing agent, these components being customarily in a state dispersed into a matrix of an (organic) binder. Further, toning agents may be preferably contained therein to control the image tone of silver. Although the photothermographic material of the present invention is stable at ordinary temperature, the material is developed, after exposure, by heating it to high temperature (for example, 80° C. or higher). Silver is formed through an oxidation-reduction reaction between the reducible silver source (acting as an oxidizing agent) and the reducing agent, the reaction being induced by heating. The oxidation-reduction reaction is promoted by the catalysis of latent images produced by exposure. Silver formed by the reaction of an organic silver salt in exposed areas provides black images, which make it possible to form images in contrast with unexposed areas.

The photothermographic material of the present invention has at least one photosensitive layer on a support. Although the photothermographic material can consist only of the photosensitive layer formed on the support, the material preferably contains at least one light-insensitive layer formed on the photosensitive layer. In order to control an amount or a wavelength distribution of light passing through the photosensitive layer, a filter layer may also be formed on the same side or the opposite side of the photosensitive layer, or dyes or pigments may also be incorporated into the photosensitive layer.

The photosensitive layer may be constituted of a plurality of layers, or of a high-sensitivity layer-a low-sensitivity layer or a low-sensitivity layer-a high-sensitivity layer to control gradation.

Various additives can be added to any of the photosensitive layer, the light-insensitive layer, and other forming layers.

Examples of supports used for the photothermographic material of the present invention include materials such as paper, paper covered with polyethylene, paper covered with polypropylene, parchment, and cloths; sheets and thin films of metals such as aluminum, copper, magnesium and zinc; glass and glass covered with metals such as chromium alloys, steel, silver, gold, and platinum; and synthetic polymer materials such as poly(alkyl methacrylates) [for example, poly(methyl methacrylate)], polyesters [for example, poly(ethylene terephthalate)], poly(vinyl acetals), polyamides [for example, nylon], and cellulose esters [for example, cellulose nitrate, cellulose acetate, cellulose acetate propionate, and cellulose acetate butyrate].

Surfactants, antioxidants, stabilizers, plasticizers, ultraviolet absorbing agents, covering assistants, and the like may also be used for the photothermographic material of the present invention.

The respective binder layers (for example, synthetic polymers) can also form self-supporting films together with chemicals in the photothermographic material of the present invention.

The supports may be covered with known auxiliary materials, for example, copolymers or terpolymers prepared from monomers which are selected from among vinylidene chloride, acrylic acid monomers (for example, acrylonitrile and methyl acrylate), unsaturated dicarboxylic acids (for example, and itaconic acid), carboxymethyl cellulose, and polyacrylamide; and similar polymeric materials.

Suitable binders are transparent or translucent, and colorless in general. They are natural polymers, synthetic resins (homopolymers and copolymers), or other film-formable media. Examples thereof include gelatin, gum arabic, poly (vinyl alcohol), hydroxyethyl cellulose, cellulose acetate, cellulose acetate butyrate, poly(vinyl pyrrolidone), casein, starch, poly(acrylic acid), poly(methyl methacrylate), poly (vinyl chloride), poly(methacrylic acid), copoly (styrenemaleic anhydride), copoly(styrene-acrylonitrile), copoly(styrene-butadiene), poly(vinyl acetals) [for example, poly(vinyl formal) and poly(vinyl butyral)], polyesters, polyurethanes, phenoxy resins, poly(vinylidene chloride), polyethoxides, polycarbonates, poly(vinyl acetate), cellulose esters, and polyamides. The binders may be applied to supports as aqueous solutions, solutions in organic solvents, or emulsions to form films.

Addition of toning agents is highly recommended. Preferred examples thereof are disclosed by *Research Disclosure*, No. 17029: imides (for example, phthalimide); cyclic imides, pyrazolin-5-ones and quinazolinones (for example, succinimide, 3-phenyl-2-pyrazolin-5-one, 1-phenylurazole, quinazoline, and 2,4-thiazolidinedione); naphthalimides (for example, N-hydroxy-1,8-naphthalimide); cobalt complexes (for example, hexaminetrifluoroacetate of cobalt) and mercaptanes (for example, 3-mercapto-1,2,4-triazole); N-(aminomethyl) aryldicarboxyimides [for example, N-(dimethylaminomethyl)phthalimide)]; combinations of blocked pyrazoles, isothiuronium derivatives and some kinds of photobleaching agents [for example, a combination of N,N'-hexamethylene(1-carbamoyl-3,5-dimethylpyrazole), 1,8-(3,6-dioxaoctane)bis(isothiuronium trifluoroacetate) and 2-(tribromomethylsulfonyl) benzothiazole]; merocyanine dyes [for example, 3-ethyl-5-((3-ethyl-2-benzothiazolinylidene)-1-methylethylidene-2-thio-2,4-oxazolidinedione]; phthalazinone, phthalazinone derivatives and metal salts of the derivatives [for example, 4-(1-naphthyl)phthalazinone, 6-chloro-phthalazinone, 5,7-dimethyloxyphthalazinone, and 2,3-dihydro-1,4-phthalazinedione]; phthalazones; combinations of phthalazinone and sulfinic acid derivatives (for example, 6-chlorophthalazinone+sodium benzenesulfinate, or 8-methylphthlazinone+sodium p-toluenesulfinate); combinations of phthalazine and phthalic acid; combinations of phthalazines (containing addition products of phthalazines) with at least one compound selected from among maleic anhydride, phthalic acid, 2,3-naphthalenedicarboxylic acid, o-phenylene acid derivatives and their anhydrides (for example, anhydrides of phthalic acid, 4-methylphthalic acid, 4-nitrophthalic acid, and tetrachlorophthalic acid); quinazolinediones, benzoxazines, 1,2-oxazine derivatives; benzoxazine-2,4-diones (for example, 1,3-benzoxazine-2,4-dione); and pyrimidines, assym-triazines (for example, 2,4-dihydroxypyrimidine), and tetrazapentalene derivatives (for example, 3,6-dimercapto-1,4-diphenyl-1H,4H-2,3a,5,6a-tetraazapentalene).

Preferred toning agents are as follows:

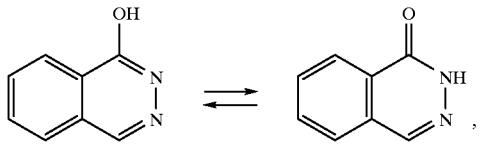

Phthalazone

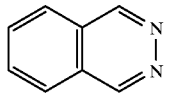

Phthalazine

More preferred toning agent is phthalazine.

The reducing agents include the so-called photographic developing agents such as phenidone, hydroquinones and catechol, and however, hindered phenols are preferred.

Examples of the preferred reducing agents which are mentioned in U.S. Pat. Nos. 3,770,448, 3,773,512 and 3,593,863, and *Research Disclosure*, Nos. 17029 and 29963 include the following compounds: aminohydroxycycloalkenone compounds (2-hydroxypiperidino-2-cyclohexenone; aminoreductone esters used as precursors of developing agents (for example, piperidinohexose reductone monoacetate); N-hydroxyurea derivatives (for example, N-p-methylphenyl-N-hydroxyurea); hydrazones of aldehydes and ketones (for example, anthracenealdehyde phenylhydrazone); phosphonamidophenols; phosphonamidoanilines; polyhydroxybenzenes (for example, hydroquinone, t-butylhydroquinone, isopropylhydroquinone, and 2,5-dihydroxyphenyl methyl sulfone); sulfhydroxamic acids (for example, benzenesulfhydroxamic acid); sulfonamidoanilines [for example, 4-(N-methanesulfonamido)aniline]; 2-tetrazolylthiohydroquinones [for example, 2-methyl-5-(1-phenyl-5-tetrazolylthio)hydroquinone; tetrahydroquinoxalines (1,2,3,4-tetrahydroquinoxaline); amidooxines; azines (for example, combinations of aliphatic carboxylic acid arylhydrazides and ascorbic acid); combinations of polyhydroxybenzenes and hydroxylamine, reductones and/or hydrazines; hydroxamic acids; combinations of azines and sulfonamidophenols; α-cyanophenylacetic acid derivatives; combinations of bis-β-naphthol and 1,3-dihydroxybenzene derivatives; 5-pyrazolones; sulfonamidophenol reducing agents; 2-phenylindane-1,3-diones; chromans; 1,4-dihydropyridines (for example, 2,6-dimethoxy-3,5-dicarboethoxy-1,4-dihydropyridines); bisphenols [for example, bis(2-hydroxy-3-t-butyl-5-methylphenyl)methane, 2,2-bis(4-hydroxy-3-methylphenyl)propane, 4,4-ethylidene-bis( 2-t-butyl-6-methyl)phenol]; ultraviolet light-sensitive ascorbic acid derivatives and 3-pyrazolidones.

Preferred reducing agents are hindered phenols represented by formula (A):

(A)

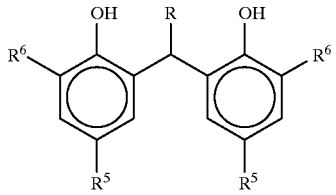

wherein R represent a hydrogen atom or an alkyl group having one to ten carbon atoms (for example, $—C_4H_9$ and 2,4,4-trimethylpentyl); and $R^5$ and $R^6$ each represent an alkyl group having one to five carbon atoms (for example, methyl, ethyl and t-butyl).

Silver halides useful as a "catalytic amount of a photocatalyst" may be any of photosensitive silver halides (for example, silver bromide, silver iodide, silver chloride, silver chlorobromide, silver iodobromide, silver chloroiodobromide, and the like), and it is preferred, however, that silver halides contain iodine ion therein. Any method can be used to add the silver halides to an image-forming layer. Then, the silver halides must be located in close proximity to reducible silver sources. The content of the silver halides is preferably from 0.75 to 30% by weight based on the reducible silver sources in general. Preparation of the silver halides can be done by conversion of silver soap portions caused by reaction with halide ions. Alternatively, a silver halide which has been previously prepared may be added during the generation of a soap. These methods may be used in combination. The latter is recommended in the present invention.

The reducible silver sources can include all materials containing reducible silver ion sources. They are preferably silver salts of organic or hetero-organic acids, and particularly preferably, aliphatic carboxylic acids having long chains (containing ten to 30 carbon atoms, and preferably 15 to 25 carbon atoms). Organic or inorganic silver salt complexes in which the whole stability constants of ligands toward silver ion are from 4.0 to 10.0 are also useful. Examples of preferred silver salts which are described in *Research Disclosure*, Nos. 17029 and 29963 include the following: salts of organic acids (for example, gallic acid, oxalic acid, behenic acid, stearic acid, palmitic acid, and lauric acid); silver salts of carboxylalkylthioureas such as 1-(3-carboxypropyl)thiourea and 1-(3-carboxypropyl)-3,3-dimethylthiourea); silver complexes of polymerization products of aldehydes and hydroxy-substituted aromatic carboxylic acids (For example, the aldehydes include formaldehyde, acetaldehyde and butyraldehyde, and the hydroxy-substituted aromatic carboxylic acids include salicylic acid, benzoic acid, 3,5-dihydroxybenzoic acid and 5,5-thiodisalicylic acid); silver salts or complexes of thioenes [for example, 3-(2-carboxyethyl)-4-hydroxymethyl-4-thiazoline-2-thioene and 3-carboxymethyl-4-thiazoline-2-thioene]; silver complexes and salts of nitrogen acids selected from among imidazole, pyrazole, urazol, 1,2,4-thiazole, 1H-tetrazole, 3-amino-5-benzylthio-1,2,4-triazole, and benzotriazole; silver salts of saccharin, 5-chlorosalicylaldoxime, and the like; and silver salts of mercaptides. Preferred silver sources are silver stearate and silver behenate, and particularly preferred one is silver behenate. The amount of the reducible silver source to be coated is preferably 3 g/m$^2$ or less, and more preferably 2 g/m$^2$ or less in terms of silver.

Sensitizing dyes usable for the photothermographic material of the present invention are described, for example, in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096.

The compounds represented by formula (I) of the present invention can also be used for hard silver halide photographic materials. It is sufficient for the silver halide photographic materials to contain a photosensitive silver halide emulsion layer on a support.

EXAMPLE 1

| Preparation of Photosensitive Emulsion A | |
|---|---|
| Solution 1 | |
| Stearic Acid | 135 g |
| Behenic Acid | 635 g |
| Distilled Water | 13 liters |
| (mixed at 85° C. for 15 minutes) | |
| Solution 2 | |
| Sodium Hydroxide | 89 g |
| Distilled Water | 1500 ml |
| Solution 3 | |
| Concentrated Nitric Acid | 21 ml |
| Distilled Water | 50 ml |
| Solution 4 | |
| Silver Nitrate | 365 g |
| Distilled Water | 2500 ml |
| Solution 5 | |
| Polyvinyl Butyral | 86 g |
| Ethyl Acetate | 4300 ml |
| Solution 6 | |
| Polyvinyl Butyral | 290 g |
| 2-Propanol | 3580 ml |
| Solution 7 | |
| N-bromosuccinimide | 9.7 g |
| Acetone | 700 ml |

Solution 2 was added with stirring vigorously to solution 1 maintained at 85° C. over a 5-minute period. Solution 3 was subsequently added to the reaction mixture over a 25-minute period, and stirring was further continued as such for 20 minutes. Thereafter, the mixture was cooled to 35° C. Solution 4 was added with stirring more vigorously to the mixture maintained at 35° C. over a 5-minute period, and stirring was further continued as such for 90 minutes. After solution 5 was then added to the resulting mixture, stirring was stopped to allow the mixture to stand, and an aqueous phase containing salts was separated to obtain an oil phase. A trace of water was separated from the oil phase by solvent removal, and solution 6 was added with stirring vigorously thereto at 50° C. Solution 7 was then added thereto over a 20-minute period, and stirring was further continued for 105 minutes to obtain photosensitive emulsion A.

The following layers were formed in that order on a biaxially oriented 175 μm-thick polyethylene terephthalate support which was colored with blue dye A and had no undercoat layer. Drying was performed at 75° C. for 5 minutes in each coating step.

| | |
|---|---|
| <Coating of Backside of the Support> | |
| Antihalation Layer (80 μm in wet thickness) | |
| Polyvinyl Butyral (as a 10% isopropanol solution) | 150 ml |
| Dye C (solvent: DMF) | 70 mg |
| <Coating of Photosensitive Layer Side of the Support> | |
| Photosensitive Layer (140 μm in wet thickness) | |
| Photosensitive Emulsion A | 73 g |
| Sensitizing Dye-1 (as a 0.1% DMF solution) | 2 ml |
| Antifoggant-1 (as a 0.01% methanol solution) | 3 ml |
| Phthalazone (as a 4.5% DMF solution) | 8 ml |
| Reducing Agent-1 (as a 10% acetone solution) | 13 ml |
| Compound | Described in Table 1 |
| Protective Layer (100 μm in wet thickness) | |
| Acetone | 175 ml |
| 2-Propanol | 40 ml |
| Methanol | 15 ml |
| Cellulose Acetate | 8.0 g |
| Phthalazine | 1.0 g |
| 4-Methylphthalic acid | 0.72 g |
| Tetrachlorophthalic acid | 0.22 g |
| Tetrachlorophthalic anhydride | 0.5 g |

Dye C

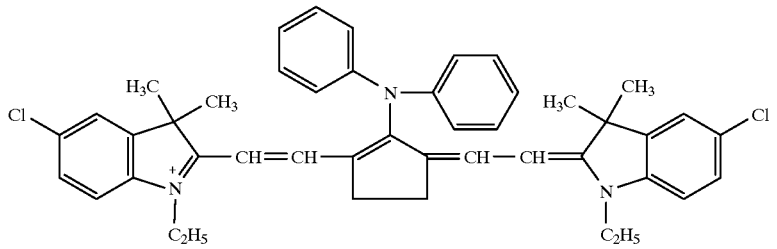

-continued

Sensitizing Dye-1

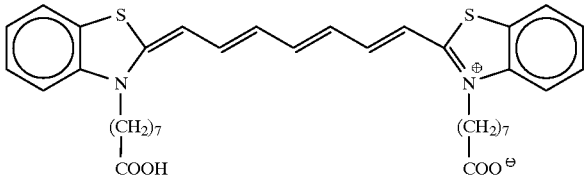

Antifoggant-1

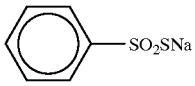

Reducing Agent-1

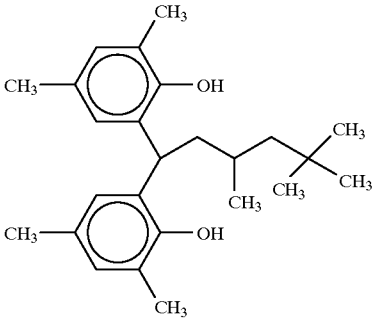

Dye A

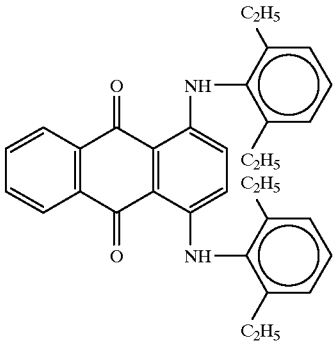

Sensitometry:

The photothermographic material samples thus prepared were cut into 14×17 inch size, exposed to a 830 nm-laser diode beam from a direction of 13° to the perpendicular plane, and subjected to heat development processing with the aid of a heat drum (120° C.×15 seconds and 125° C.×15 seconds). Then, the fog values were measured. The maximum densities of the respective samples were measured, which were shown as their relative values, assuming a maximum density of sample No.1 to be 100. A result is shown in Table 1.

Evaluation of Storage Characteristics:

Three sheets of the respective samples were placed in a closed vessel maintained at 25° C.-55%, and allowed to stand at 50° C. for 7 days (forced aging). The second sheet of the these and a sample which underwent comparative aging (stored in a light-shielding vessel at room temperature) were subjected to the same processing as above to measure the densities of fog portions.

(Fog Increase)=(Fog on Forced Aging)−(Fog on Comparative Aging)

A result is shown in Table 1.

TABLE 1

| Sample No. | Compounds: Compounds | Compounds: Contents (mmol/m$^2$) | Development Fog: 120° C. × 15 sec | Development Fog: 125° C. × 15 sec | Maximum Density (Relative Values) | Storage Characteristics (Fog Increase) 120° C. × 15 sec | Notes |
|---|---|---|---|---|---|---|---|
| 1 | — | — | 0.16 | 0.23 | 100 | 0.20 | Comparative Example |
| 2 | Comparative Compound a | 0.8 | 0.14 | 0.17 | 70 | 0.10 | Comparative Example |
| 3 | Comparative Compound b | 0.8 | 0.13 | 0.13 | 66 | 0.03 | Comparative Example |
| 4 | Comparative Compound c | 0.8 | 0.13 | 0.13 | 67 | 0.04 | Comparative Example |
| 5 | Comparative Compound d | 0.8 | 0.14 | 0.15 | 62 | 0.06 | Comparative Example |
| 6 | Comparative Compound d | 1.6 | 0.13 | 0.14 | 52 | 0.05 | Comparative Example |
| 7 | Compound 1 | 0.8 | 0.13 | 0.15 | 92 | 0.03 | Present Invention |
| 8 | Compound 1 | 1.6 | 0.12 | 0.14 | 88 | 0.02 | Present Invention |
| 9 | Compound 2 | 0.8 | 0.13 | 0.14 | 94 | 0.03 | Present Invention |
| 10 | Compound 2 | 1.6 | 0.12 | 0.13 | 90 | 0.01 | Present Invention |
| 11 | Compound 5 | 0.8 | 0.13 | 0.15 | 90 | 0.03 | Present Invention |
| 12 | Compound 5 | 1.6 | 0.13 | 0.14 | 87 | 0.02 | Present Invention |
| 13 | Compound 6 | 0.8 | 0.13 | 0.15 | 89 | 0.04 | Present Invention |
| 14 | Compound 6 | 1.6 | 0.12 | 0.14 | 86 | 0.02 | Present Invention |
| 15 | Compound 10 | 0.8 | 0.13 | 0.15 | 88 | 0.04 | Present Invention |
| 16 | Compound 10 | 1.6 | 0.12 | 0.14 | 86 | 0.03 | Present Invention |
| 17 | Compound 13 | 0.8 | 0.13 | 0.15 | 90 | 0.03 | Present Invention |
| 18 | Compound 14 | 0.8 | 0.13 | 0.14 | 91 | 0.03 | Present Invention |
| 19 | Compound 18 | 0.8 | 0.14 | 0.16 | 89 | 0.04 | Present Invention |

TABLE 1-continued

| | | | | | | | |
|---|---|---|---|---|---|---|---|
| 20 | Compound 24 | 0.8 | 0.13 | 0.15 | 90 | 0.04 | Present Invention |

Comparative Compound a (described in JP-B-54-165):

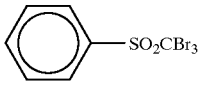

Comparative Compound b (described in European Patent 605,981A1):

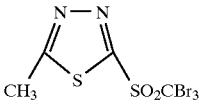

Comparative Compound c (described in European Patent 631,176A1):

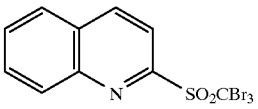

Comparative Compound d (described in JP-A-50-137126):

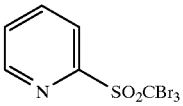

Table 1 reveals that the samples of the present invention have sufficient sensitivity and exhibit low fogging and satisfactory storage stability.

EXAMPLE 2

| Preparation of Photosensitive Emulsion B | |
|---|---|
| Solution 1 | |
| Stearic Acid | 135 g |
| Behenic Acid | 635 g |
| Distilled Water | 13 liters |
| (mixed at 85° C. for 15 minutes) | |
| Solution A | |
| Cubic AgBrI (I = 4 mol %) prepared beforehand (grain size: 0.06 μm) 0.22 mol in terms of silver | |
| Distilled Water | 1250 ml |
| Solution 2 | |
| Sodium Hydroxide | 89 g |
| Distilled Water | 1500 ml |
| Solution 3 | |
| Concentrated Nitric Acid | 19 ml |
| Distilled Water | 50 ml |
| Solution 4 | |
| Silver Nitrate | 365 g |
| Distilled Water | 2500 ml |
| Solution 5 | |
| Polyvinyl Butyral | 86 g |
| Ethyl Acetate | 4300 ml |
| Solution 6 | |
| Polyvinyl Butyral | 290 g |
| 2-Propanol | 3580 ml |

Solution A was added with stirring vigorously over a 10-minute period to solution 1 maintained at 85° C., and successively, solution 2 was added thereto over a 5-minute period and solution 3 over a 25-minute period. Stirring was continued as such for 20 minutes, and the resulting mixture was then cooled to 35° C. Solution 4 was added with stirring more vigorously to the cooled mixture at 35° C., and stirring was further continued as such for 90 minutes. Solution 5 was then added thereto, and stirring was stopped to allow the resulting mixture to stand. An aqueous phase containing salts was separated from the mixture to obtain an oily layer. A trace amount of water was removed from the oily layer by solvent removal, and solution 6 was added thereto with stirring vigorously at 50° C., and stirring was further continued for 105 minutes to obtain emulsion B.

Test was performed similarly to example 1, with the proviso that the antihalation layer was provided under the photosensitive layer on the support.

The samples in which compounds of the present invention were used exhibit low fogging similarly to example 1.

Thus, the photographic materials of the present invention have been found to have high sensitivity, and exhibit low fogging and satisfactory storage stability.

What is claimed is:

1. A photothermographic material comprising (a) a reducible silver source, (b) a photocatalyst, (c) a reducing agent, (d) a binder, and (e) a compound represented by the following formula (I):

(I)

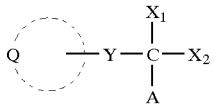

wherein Q represents an atomic group necessary to form a six-membered unsaturated heterocycle containing two to four nitrogen atoms; Y represents —CO—, —SO—; or —$SO_2$—; $X_1$ and $X_2$ each represents a halogen atom; and A represents a hydrogen atom or an electron withdrawing group.

2. The photothermographic material claimed in claim 1, which is sensitized in the infrared region for exposure to an infrared laser beam.

3. The photothermographic material claimed in claim 1, wherein the compound represented by formula (I) is represented by formula (I-a):

(I-a)

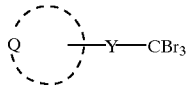

wherein Q and Y have the same meanings as Q and Y in formula (I).

4. The photothermographic material claimed in claim 1, wherein the compound represented by formula (I) is represented by formula (I-b):

(I-b)

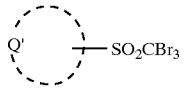

wherein Q' represents an atomic group necessary to form a pyrazine ring, a pyrimidine ring or a pyridazine ring.

5. The photothermographic material claimed in claim 1, wherein the compound represented by formula (I) is represented by formula (I-c):

(I-c)

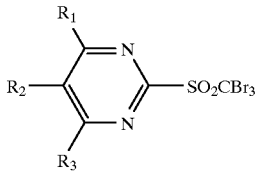

wherein $R_1$, $R_2$ and $R_3$ each represents an hydrogen atom or a substituent group.

6. The photothermographic material claimed in claim 1, wherein the compound represented by formula (I) is contained in a photosensitive layer.

7. The photothermographic material claimed in claim 1, wherein the compound represented by formula (I) is contained in an amount of from $10^{-4}$ to 1 mol per mol of silver.

8. The photothermographic material claimed in claim 1, wherein said six-membered unsaturated heterocycle represented by Q is selected from the group consisting of pyrazine, pyrimidine, pyridazine, triazine, tetrazine, purine, pyrazolopyradine, triazolo-pyridazine, triazolopyrazine, phthalazine, benzotriazine, quinoxaline, quinazoline, cinnoline, pteridine, perimidine, tetrazaindene and pyridopyridazine.

9. The photothermographic material claimed in claim 1, wherein said six-membered unsaturated heterocycle represented by Q contains a substituent group selected from the group consisting of an alkyl group, an alkenyl group, an alkynyl group, an aryl group, an amino group, an alkoxy group, an aryloxy group, an acyl group, an alkoxycarbonyl group, an aryloxycarbonyl group, an acyloxy group, an acylamino group, an alkoxycarbonylamino group, an aryloxycarbonyl-amino group, a sulfonylamino group, a sulfamoyl group, a carbamoyl group, an alkylthio group, an arylthio group, a sulfonyl group, a sulfinyl group, an ureido group, a phosphoric acid amide group, a hydroxy group, a mercapto group, a halogen atom, a cyano group, a sulfo group, a carboxyl group, a nitro group, a hydroxamic acid group, a sulfino group, a hydrazino group, and a heterocyclic group.

10. The photothermographic material claimed in claim 1, wherein Y represents —CO— or —SO—.

11. The photothermographic material claimed in claim 1, wherein the halogen atoms represented by $X_1$ and $X_2$, which may be the same with or different from one another, each are a chlorine atom or a bromine atom.

12. The photothermographic material claimed in claim 1, wherein the electron withdrawing groups represented by A are groups having Hammett's substituent constants $\sigma_p$'s of 0.01 or more.

13. The photothermographic material claimed in claim 1, wherein the electron withdrawing group represented by A is a halogen atom; aliphatic, aromatic or heterocyclic sulfonyl group; aliphatic, aromatic or heterocyclic acyl group; or aliphatic, aromatic or heterocyclic oxycarbonyl group.

14. The photothermographic material claimed in claim 5, wherein $R_1$ and $R_3$ are each a hydrogen atom, an alkyl group, an aryl group, or a heterocyclic group, and $R_2$ is a hydrogen atom, an alkyl group, an aryl group, or a heterocyclic group.

15. The photothermographic material claimed in claim 1, wherein the compound represented by formula (I) is selected from the group consisting of compounds 1–25:

1.

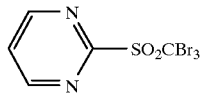

2.

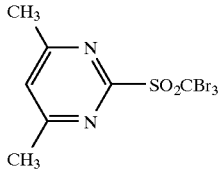

3.

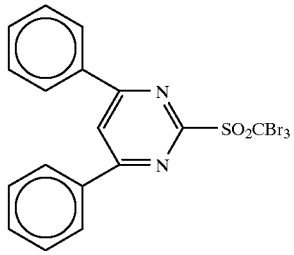

4.

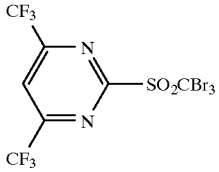

-continued
5.
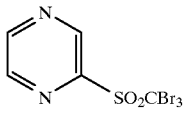
6.
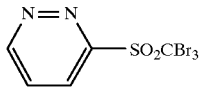
7.
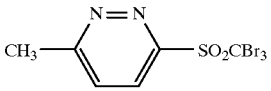
8.
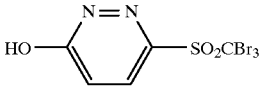
9.
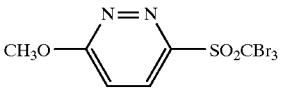
10.
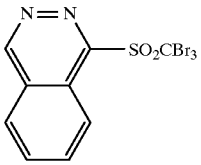
11.
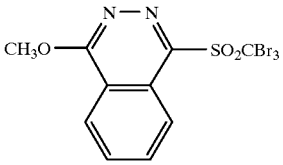
12.
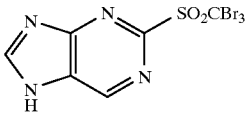
13.
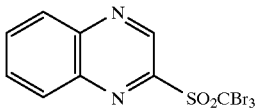
-continued
14.
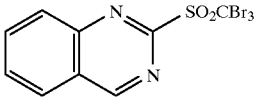
15.
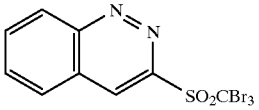
16.
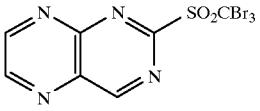
17.
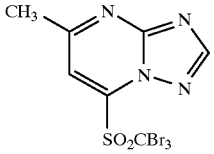
18.
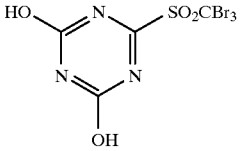
19.
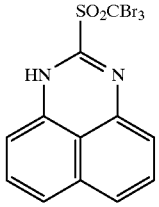
20.
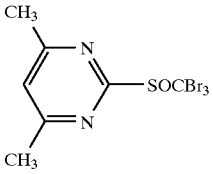
21.
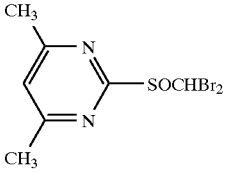

-continued

22.

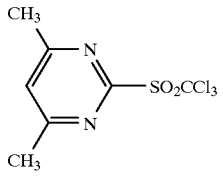

23.

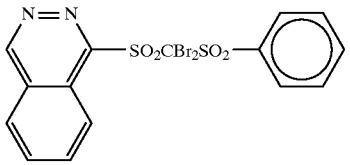

24.

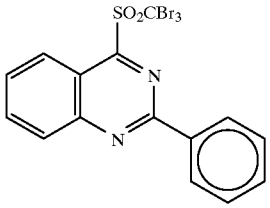

25.

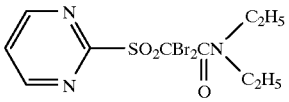

26.

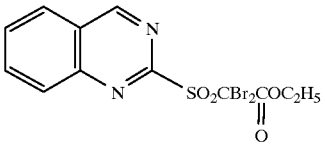

27.

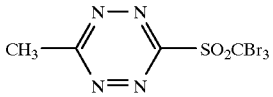

28.

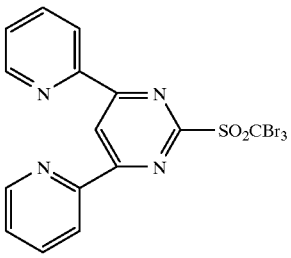

-continued

29.

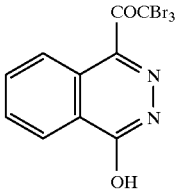

30.

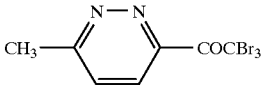

31.

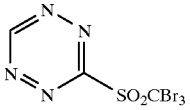

32.

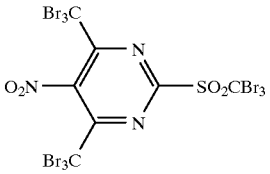

33.

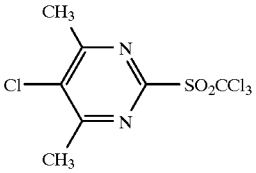

34.

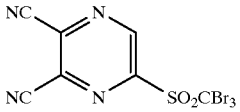

35.

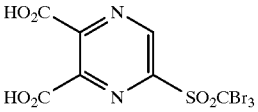

16. The photothermographic material claimed in claim 7, wherein the compound represented by formula (I) is contained in an amount from $10^{-3}$ to 0.3 mol per mol of silver.

17. A photothermographic material comprising (a) an organic silver salt, (b) a reducing agent, (c) a photosensitive silver halide, a photosensitive silver halide-formable component, or a mixture thereof (d) a binder, and (e) a compound represented by formula (I):

(I)

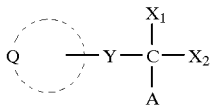

wherein Q represents an atomic group necessary to form a six-membered unsaturated heterocycle containing two to four nitrogen atoms; Y represents —CO—, —SO—, or —$SO_2$—; $X_1$ and $X_2$ each represents a halogen atom; and A represents a hydrogen atom or an electron withdrawing group.

18. The photothermographic material claimed in claim 17, which is sensitized in the infrared region for exposure to an infrared laser beam.

* * * * *